US008179277B2

(12) United States Patent
Hollander

(10) Patent No.: US 8,179,277 B2
(45) Date of Patent: May 15, 2012

(54) ALIGNMENT OF FLAGSTAFFS IN THE MARCHING FORMATIONS

(76) Inventor: Hunter Hollander, Los Angeles, CA (US)

( * ) Notice: Subject to any disclaimer, the term of this patent is extended or adjusted under 35 U.S.C. 154(b) by 150 days.

(21) Appl. No.: 12/326,190

(22) Filed: Dec. 2, 2008

(65) Prior Publication Data

US 2010/0134311 A1 Jun. 3, 2010

(51) Int. Cl.
*G08B 21/00* (2006.01)

(52) U.S. Cl. ..... 340/689; 340/686.2; 33/366.12; 33/392; 33/366.21

(58) Field of Classification Search ..... 340/686.2, 340/689, 686.3; 33/365–402; 702/154
See application file for complete search history.

(56) References Cited

U.S. PATENT DOCUMENTS 2,834,118 A * 5/1958 Jackson ..... 33/372
3,320,674 A * 5/1967 Tourtellotte ..... 33/373
3,617,664 A * 11/1971 Tetrault ..... 200/61.51
3,752,945 A * 8/1973 Achterberg ..... 200/277
3,816,680 A * 6/1974 Suzuki et al. ..... 200/61.51
4,365,421 A * 12/1982 Byrum ..... 33/366.21
4,603,484 A * 8/1986 Strothmann ..... 33/366.22
4,884,067 A * 11/1989 Nordholm et al. ..... 340/689
5,153,566 A * 10/1992 Yun ..... 340/689
5,237,135 A * 8/1993 Wolski ..... 200/61.45 R
5,372,446 A * 12/1994 Chamberlin ..... 403/122
5,610,338 A * 3/1997 Kato et al. ..... 73/652
5,673,491 A * 10/1997 Brenna et al. ..... 33/366.24
6,087,936 A * 7/2000 Woods ..... 340/566
6,144,308 A * 11/2000 Dunne ..... 340/689
6,392,556 B2 * 5/2002 Tomich ..... 340/689
6,594,912 B2 * 7/2003 Ashjaee ..... 33/366.24
2004/0251406 A1 * 12/2004 Figueria ..... 250/231.1
2007/0277386 A1 * 12/2007 Bozzone et al. ..... 33/391

* cited by examiner

*Primary Examiner* — Benjamin C Lee
*Assistant Examiner* — Peter Mehravari
(74) *Attorney, Agent, or Firm* — Michaud-Kinney Group LLP

(57) ABSTRACT

A device for maintaining a flag in a desired position, and comprising a position transducer is disclosed. A support mounts the position transducer on a flagstaff. An alarm indicates a deviation in the position of the transducer from the desired position. The alarm has an audio output. The audio output of the alarm optionally indicates the direction of the deviation whereby a user may correct the position of the flag. The position transducer may comprise a central conductive member and a plurality of contacts surrounding that central conductive member. More particularly, the central conductive member may be a conductive ball resting on a concave conductive electrode.

12 Claims, 9 Drawing Sheets

ALIGNMENT OF FLAGSTAFFS IN THE MARCHING FORMATIONS

TECHNICAL FIELD

The invention relates to devices and methods for maintaining the alignment of a flag being held by a marcher or a plurality of flags each held by individuals in group of marchers, for example in a parade, within an acceptable range of angles.

BACKGROUND OF THE INVENTION

Many parades involve the carrying of flags or colors by one or a number of individuals, often at the head of a particular unit. Particularly where there are a number of individuals each carrying a flag in relatively close proximity to each other, the appearance of the colors bearers depends upon their holding their respective flags at an angle with an orientation within an acceptable range. Moreover, poles supporting flags in close proximity to each other should be oriented at approximately the same angle and tilted in the same direction.

Achieving this may be difficult because flag bearers are required to look forward, and are not free to look up at each other's flags to determine whether the desired alignment has been achieved.

SUMMARY OF THE INVENTION

In accordance with the invention, devices and methods are provided for allowing individuals, for example, individuals in a color guard, to precisely control flag orientation and angle. In accordance with a further aspect of the invention, different individuals in a color guard are provided with a device for ensuring that all flags held by members of the color guard are held with the same orientation.

In accordance with the present invention a device for maintaining a flag in a desired position, and comprising a position transducer is provided. A support mounts the position transducer on a flagstaff. An alarm indicates a deviation in the position of the transducer from the desired position. The alarm has an audio output. The audio output of the alarm optionally indicates the direction of the deviation whereby a user may correct the position of the flag. The position transducer may comprise a central conductive member and a plurality of contacts surrounding that central conductive member. More particularly, the central conductive member may be a conductive ball resting on a concave conductive electrode.

Optionally the central conductive member may be housed in a transparent member whereby its position may be visually determined.

The position transducer may be secured to the flagstaff by a collar and a ball and socket attachment.

Optionally, the position transducer has an audio output which may vary in pitch and has bursts which may vary in repetition rate to indicate the position of the flagstaff, in order to allow a user to correct the position of the flag.

BRIEF DESCRIPTION THE DRAWINGS

The operation of the invention will become apparent from the following description taken in conjunction with the drawings, in which.

DETAILED DESCRIPTION OF THE PREFERRED EMBODIMENTS

Figure 1:
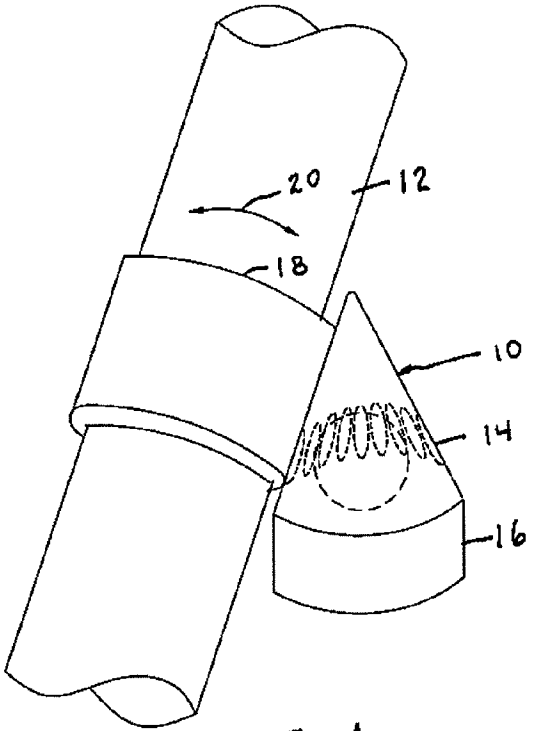
FIG. 1 is a diagrammatic perspective view of the inventive position transducing device and alarm.

Referring to FIG. 1, an orientation device 10 constructed in accordance with the present invention is illustrated mounted on a flagstaff 12. Orientation device 10 comprises a conical transducer housing 14 which houses a mechanism for determining position. The inventive orientation device 10 also includes an alarm circuit housing 16, which houses circuitry for receiving the output of the mechanism for determining position and providing an appropriate alarm designed to provide guidance to the flag bearer as toward how to put the flagpole into the proper position. Secured to housing 14 is a band 18. Band 18 is tightly mounted on flagstaff 12. Band 18 is sufficiently tight so as to grip flagstaff 12 frictionally and maintain its position unless subjected to force. Band 18 may be rotated in the directions indicated by arrows 20 to achieve desired operation, as will be described in detail below.

Figure 2:
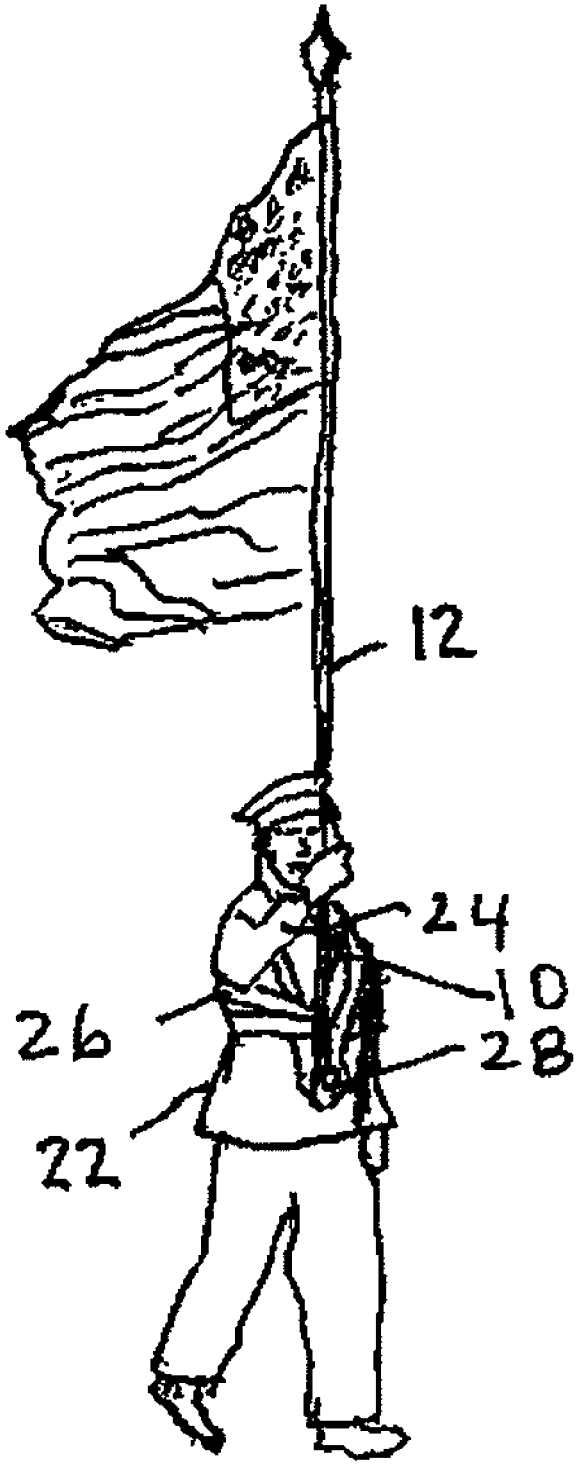
FIG. 2 is perspective view of a marcher using a flagstaff alignment device in accordance with the present invention.

As can be seen with reference to FIG. 2, a flag bearer 22 typically holds flag staff 12 using one arm 24, or alternatively two arms. Typically, the flag bearer 22 is assisted in this task by a flag supporting belt 26, which incorporates a support cup 28 which precedes the bottom end of flagstaff 12, thus helping to support the flag without the unduly rapid onset of fatigue in the arms.

In connection with this, it is noted that fatigue may be caused by a variety of factors. For example, the weight of a flagstaff 12 and a flag 28 may be substantial. In addition, substantial winds may result in applying relatively large forces to a flag. Some idea of the force involved may be understood when it is considered that fabric having an area not much larger than many flags is sufficient to function as a sail in a small sailboat or windsurfing apparatus. Moreover, as can be seen in FIG. 2, such force is exerted at the end of a relatively large moment arm which functions as a lever, multiplying the perceived force by perhaps a factor of three or four, depending upon the configuration of the flag and flagstaff involved.

In accordance with the invention, it is contemplated that when the flag is oriented at the proper angular position, device 10 will emit no noise. However, in the event of deviation of flagstaff 12 from the proper angular position, the angular orientation of device 10 will vary with movement, by way of change in roll, pitch and/or yaw. Such deviation is detected by device 10 and an alarm is sounded. In accordance with a preferred embodiment of the invention, the alarm will vary in a manner which will indicate to the flag bearer the proper corrective action to be taken to restore the desired angular position of the flag and flagstaff.

For example, if the flag is leaning forward from the desired position, device 10 may emit a high-pitched tone. Alternatively, if the flag is leaning backward from the desired position, device 10 may emit a low pitched tone. In the event that the flag is leaning to the left, device 10 may emit a series of clicks at a relatively rapid rate. In the event that the flag is leaning to the right, device 10 may emit a series of clicks at a relatively slow rate.

In similar fashion, if, in addition to leaning left or right, the flag is also leaning forwardly or backwardly, the clicks can be replaced by beeps, with high-pitched beeps indicating a forward lean and low pitched beeps indicating a backward lean. Thus, by listening to the frequency of the tone, if any, and the rapidity of the clicks or beeps, the flag bearer is instructed on how to right the flag to the proper position.

Figure 3:
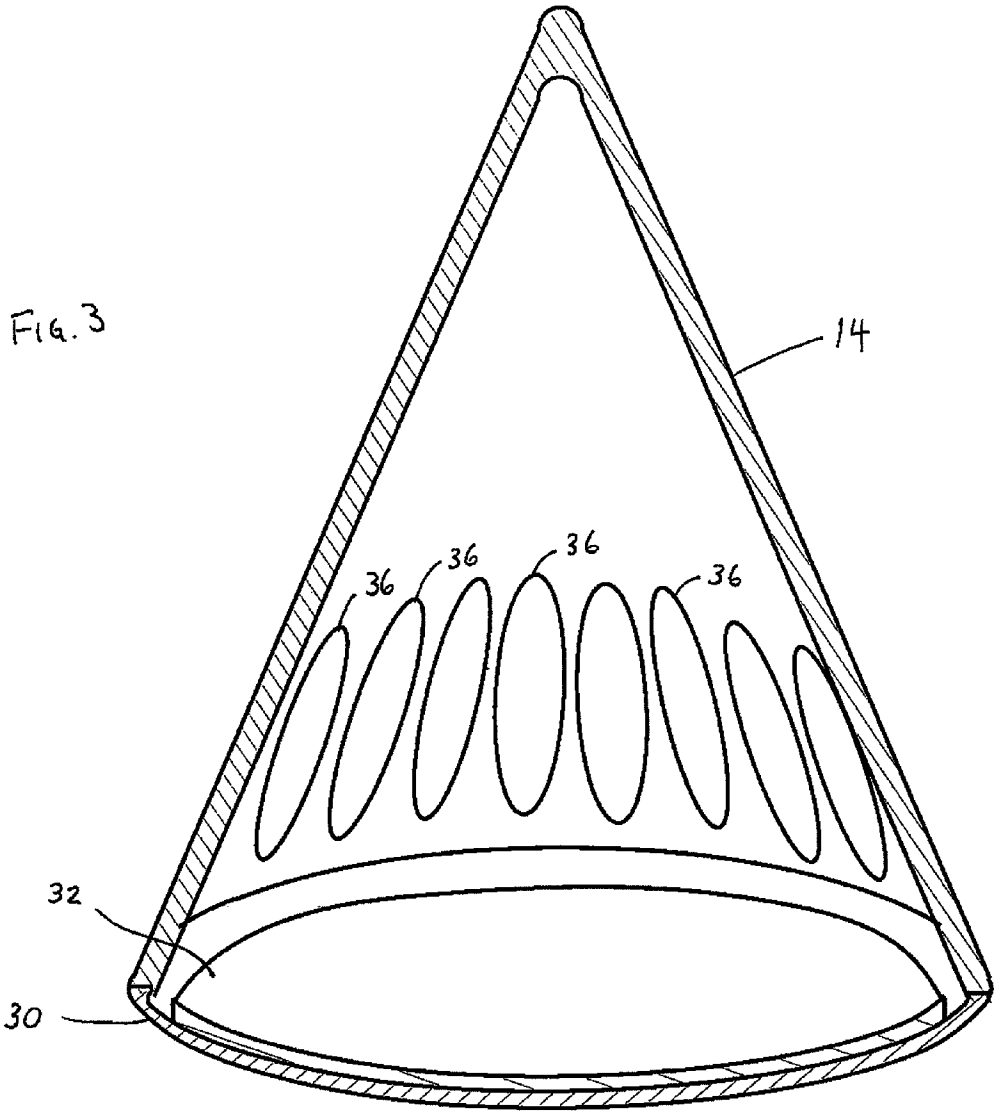
FIG. 3 is a diagrammatic cross-sectional view of the inventive position transducer.

While a number of mechanisms may be employed to detect changes in orientation, one such mechanism is illustrated in FIG. 3. In the embodiment illustrated in FIG. 3, transducer housing 14 includes a floor 30 and a floor electrical contact 32. A plurality of sidewall electrical contacts 36 are positioned at equal intervals along the inner wall of transducer housing 14. In accordance with the preferred embodiment, sixteen such sidewall contacts 36 are provided, although fewer numbers of contacts, for example four or eight, will function well as will larger numbers of contacts. Floor 30 and electrical contact 32 are both concave.

Figure 5:
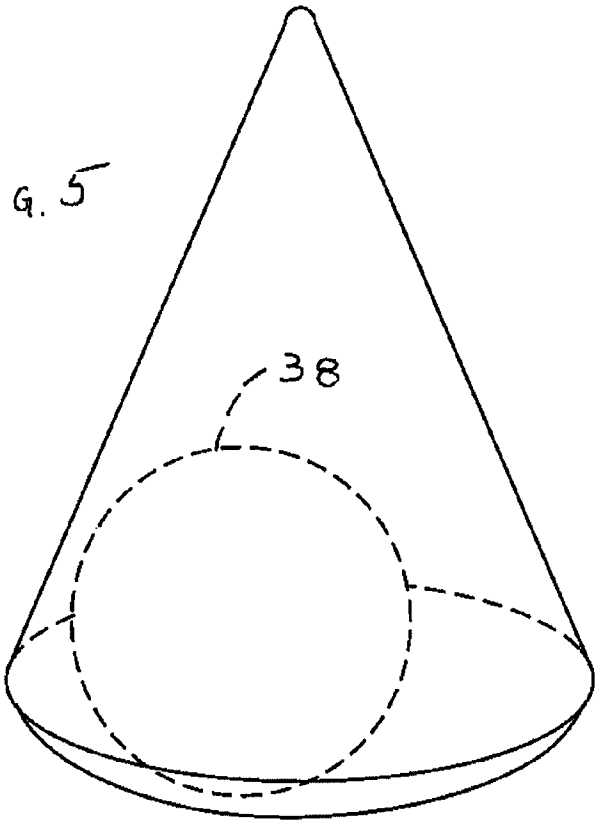
FIG. 5 is a view similar to FIG. 4 illustrating the concavity of the base of the transducer.
Figure 4:
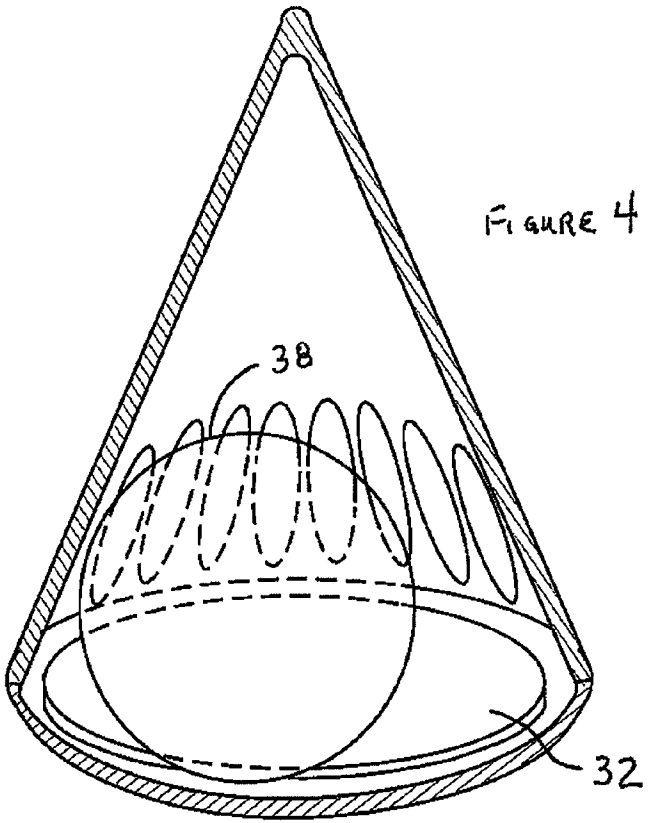
FIG. 4 is a view similar to FIG. 3 in cutaway perspective illustrating the inventive transducer.

Transducer housing 14 also houses a conducting ball 38 as may be seen most clearly in FIG. 4. When flagstaff 12 is properly aligned, ball 38 rests in the middle of electrical contact 32. Because contact 32 is concave, when the flagstaff is in the proper position, ball 38 tends to roll into the center of contact 32. This may be most easily understood from FIG. 5.

Figure 8:
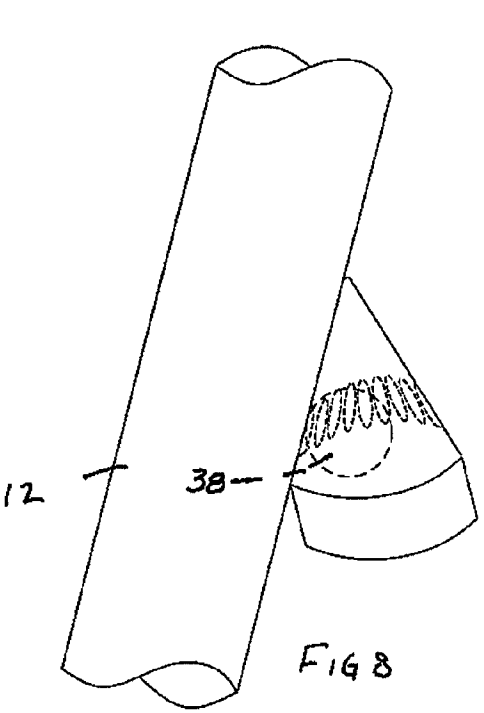
FIG. 8 illustrates a flag with the inventive device tilted rearwardly.
Figure 7:
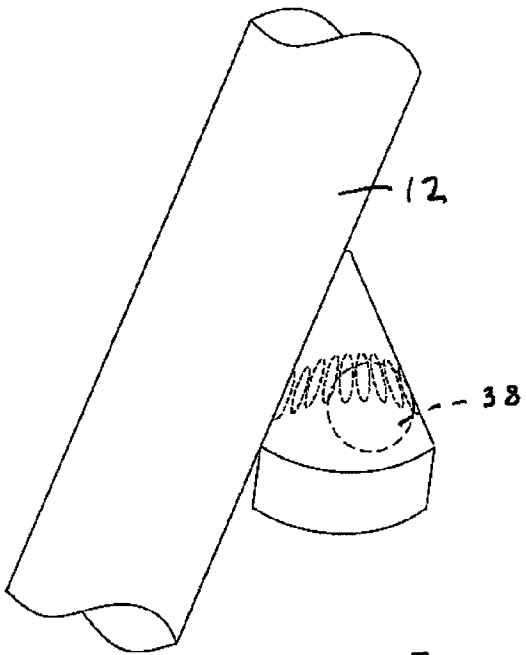
FIG. 7 illustrates a flag with the inventive device tilted forwardly.
Figure 6:
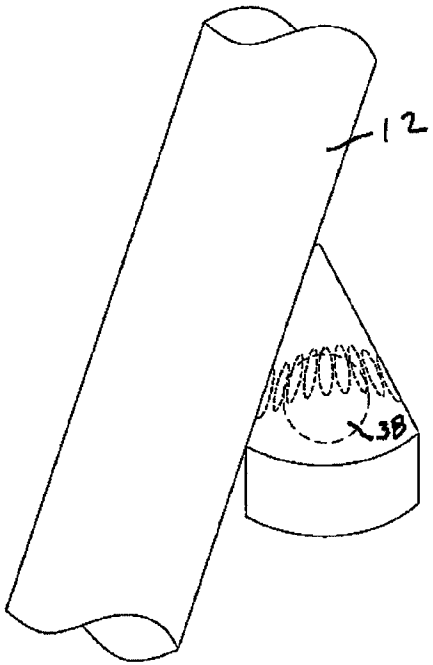
FIG. 6 illustrates a flag with the inventive device properly aligned.

As is illustrated in FIGS. 6-8, varying the angular orientation of flagstaff 12 will cause ball 38 to change position.

Figure 9:
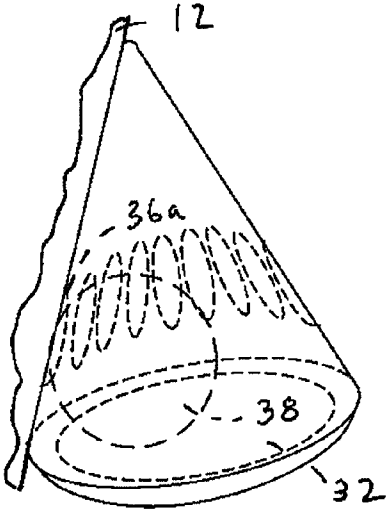
FIG. 9 is a diagrammatic view which illustrates a flag with the inventive device tilted rearwardly revealing its inner workings.
Figure 11:
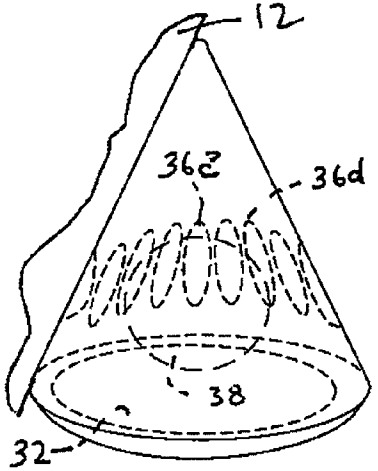
FIG. 11 is a diagrammatic view which illustrates a flag with the inventive device tilted to the left revealing its inner workings.
Figure 12:
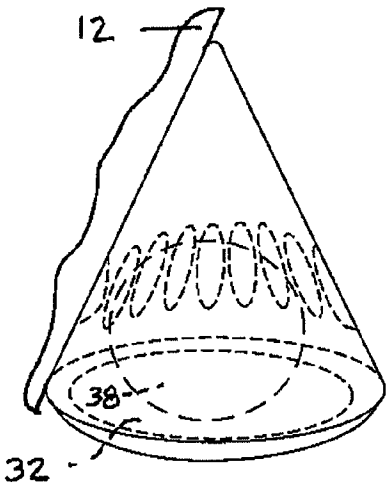
FIG. 12 is a diagrammatic view which illustrates a flag with the inventive device tilted to the right revealing its inner workings.

However, if the flag is subjected to angular displacement from the desired position, ball 38 will tend to roll toward the inner sidewall of conical housing 14 in the direction which indicates the direction of the deviation and with a displacement which indicates the magnitude of that deviation. For example, if flagstaff 12 is pulled rearwardly, ball 38 will move to the position illustrated in FIG. 9. On the other hand, if flagstaff 12 is pulled forwardly, ball 38 will move to the position illustrated in FIG. 10. Likewise, if flagstaff 12 is pulled to the left, ball 38 will move to the position illustrated in FIG. 11, while, if flagstaff 12 is pulled to the right, ball 38 will move to the position illustrated in FIG. 12.

When flagstaff 12 is pulled rearwardly, ball 38 moves into contact with electrical contact 36*a*, as illustrated in FIG. 1. Because ball 38 is resting on electrical contact 32 and contacting electrical contact 36*a*, it completes an electrical circuit between these two electrodes, thus resulting in detection of the position of ball 38. Thus, application of a voltage present on, for example, contact 32 to contact 36*a* indicates a rearward tilt in the angular position of flagstaff 12.

Figure 10:
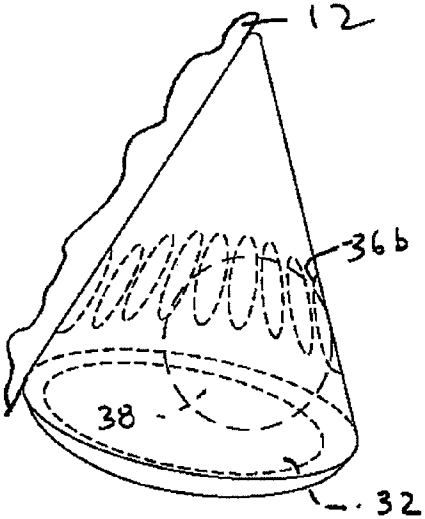
FIG. 10 is a diagrammatic view which illustrates a flag with the inventive device tilted forwardly revealing its inner workings.

Similarly, when flagstaff 12 is pulled forwardly, ball 38 moves toward contact 36*b* as illustrated in FIG. 10. Likewise, if flagstaff 12 is pulled to the left, ball 38 will move to the position illustrated in FIG. 8, bearing against electrical contact 36*c*, which when it receives voltage from ball 38 indicates tilting of the flag to the left. From the above discussion, it will be understood that if another electrode is actuated, other orientations of flagpole 12 will be indicated. For example, contact of ball 38 with electrode 36*d* would indicate tilting forwardly and to the left.

Figure 13:
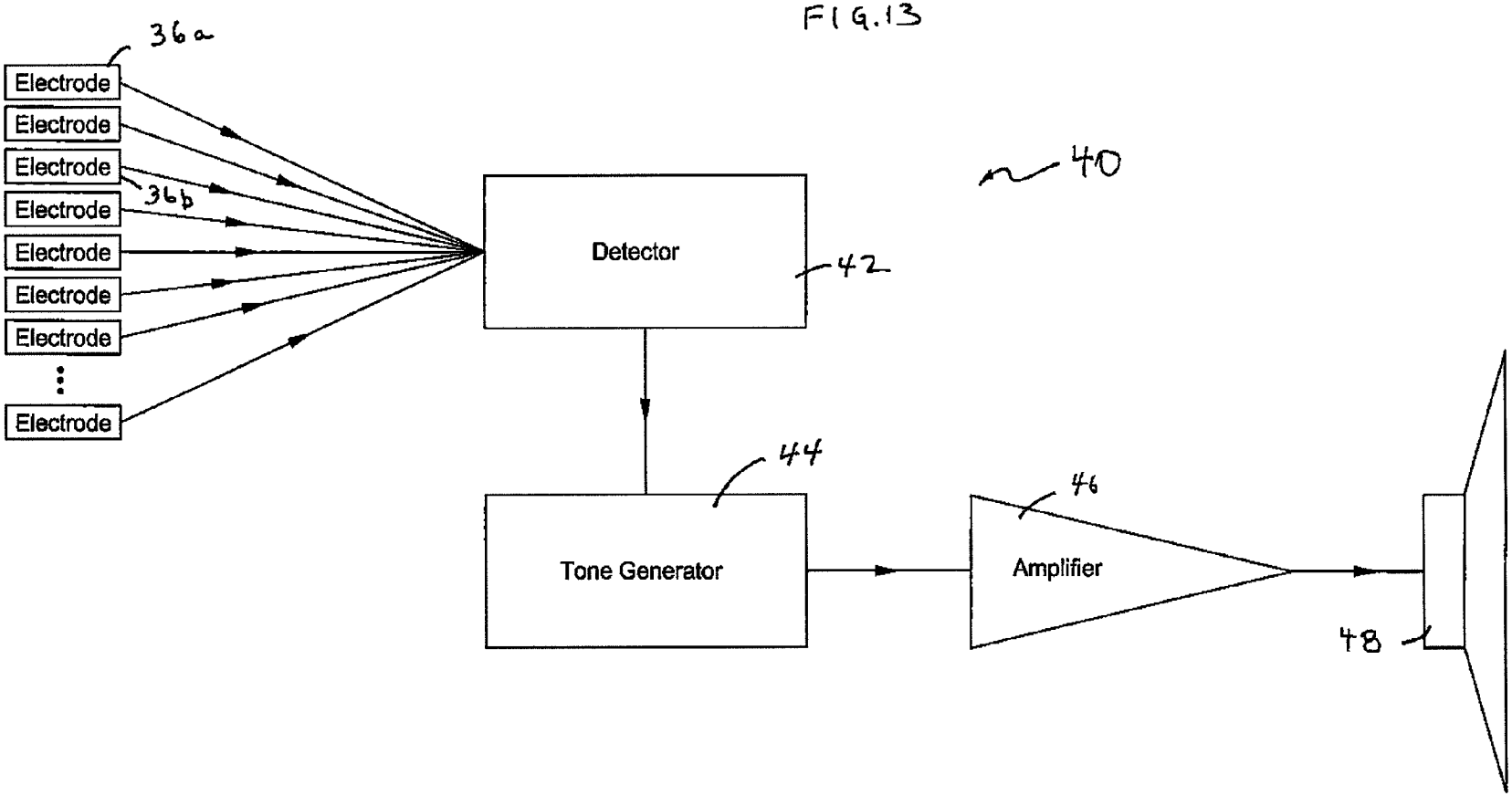
FIG. 13 is a schematic block diagram illustrating the electrical circuit of the inventive flag position transducer.

Referring to FIG. 13, the translation of individual electrode actuations into an audio cue to be interpreted by the flag bearer is achieved by a circuit 40 illustrated in FIG. 13. Actuations of voltage on an electrode is detected by detector 42 which, in turn, drives a tone generator 44 to produce the desired audio signal, for example the clicks, and beeps of various pitch as outlined above. The signal is then sent to amplifier 46 which drives a loudspeaker 48.

Figure 14:
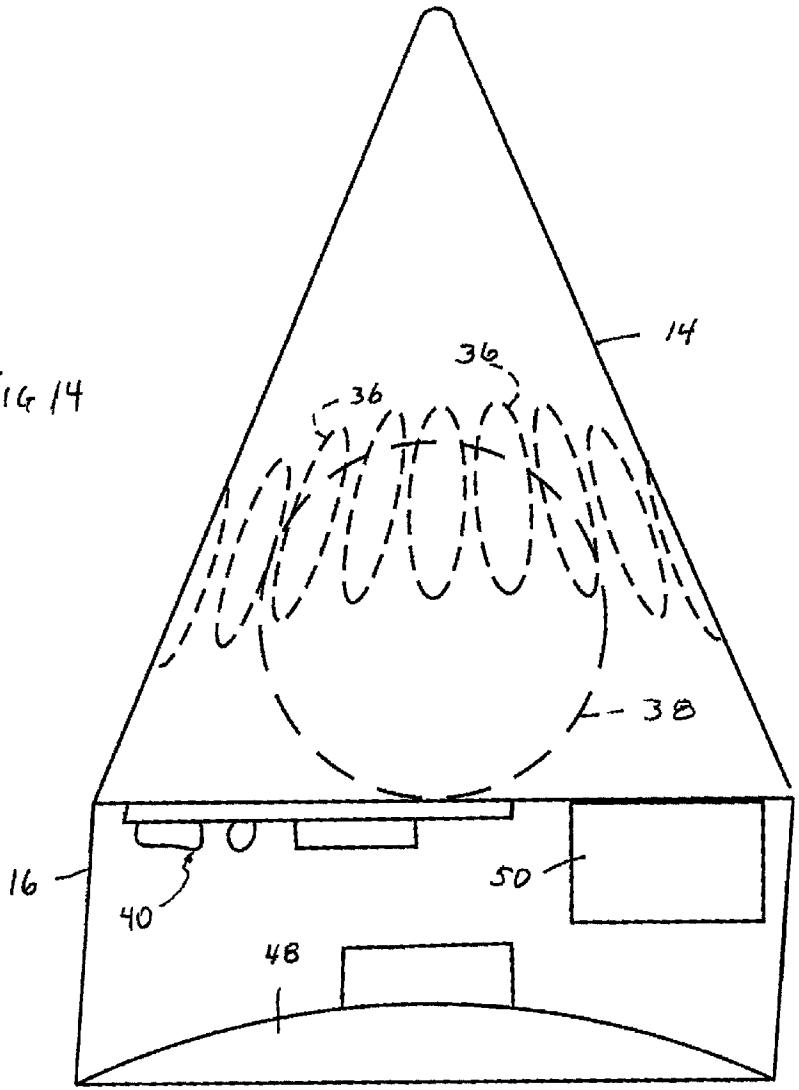
FIG. 14 is a schematic representation of the location of the components of the inventive transducer.

As can be seen in FIG. 14, control circuit 40 is contained within housing 16. Housing 16 also houses loudspeaker 48 and a power supply, such as battery 50.

In accordance with the method of the present invention, because of the fixed position of cup 28, use of a cup is desirable but not required. Nevertheless, the combination of the cup and the inventive position detecting device is particularly advantageous.

It is also contemplated in accordance with the invention that an orientation device 10, such as that illustrated in FIGS. 1-14 (which has a particular flagstaff orientation associated with it), may be replaced with a device 110 capable of accommodating a range of flagstaff orientations.

Figure 15:
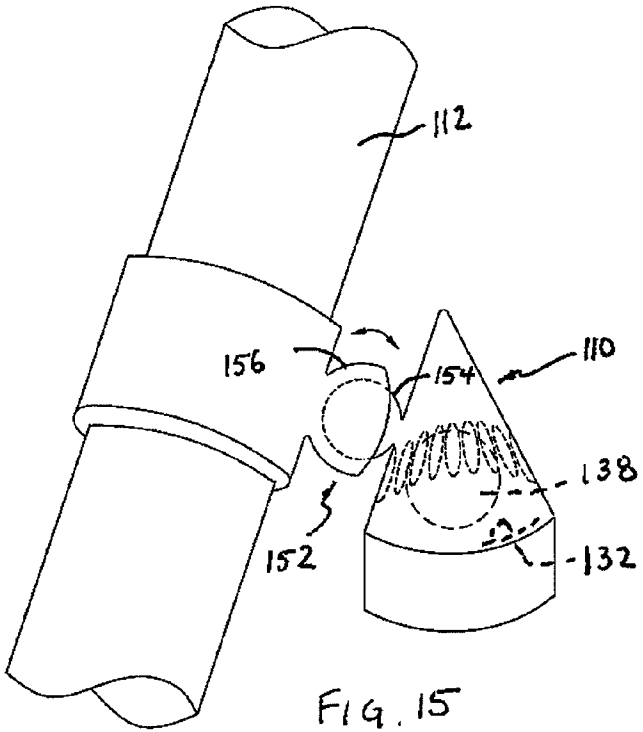
FIG. 15 illustrates an alternative embodiment of the invention in which the orientation of a flag may be adjusted.

With reference to FIG. 15, this is achieved through the use of a joint 152 comprising a ball 154 and socket 156 which allows orientation with three angular degrees of freedom, namely, roll, pitch and yaw.

Figure 16:
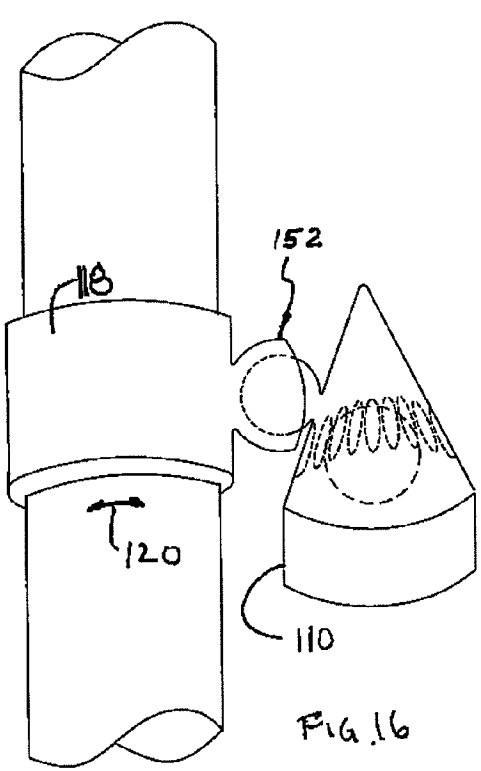
FIG. 16 is a view similar to FIG. 15 illustrating the flag in a vertical position with the inventive transducer aligned in a manner calculated to assist the flag bearer in maintaining the vertical position.

When it is desired to use an adjustable device as in FIG. 15, the flagstaff 112 is positioned at the desired angular orientation and device 110 is oriented until no sound is heard. The same may be assisted by making conical housing 114 transparent. This enables one to see ball 138 and position it in the middle of floor contact 132. Transparency can be achieved by making conical housing 114 from a transparent material such as plastic, or by incorporating a great number of holes in an otherwise opaque housing, for example, forming a screen or a cage. By way of example, a number of pie shaped holes may be incorporated in the housing, with the cone being defined by a plurality of struts, each with an end at the apex of the cone and having its other end at the base of the cone For example, if a flag is oriented in the vertical position as illustrated in FIG. 16, collar 118 may be rotated in the direction of arrows 120 and ball 154 moved with respect to socket 156 until ball 138 is in the center of floor contact 132.

Still yet another possibility for an angular position transducer in accordance with the invention is illustrated in FIGS. 17-21. Generally, the transducer 210 is arranged in a pendulum fashion, with a conductive pendulum bob 238 connected by a conductive string 260. A voltage is applied to string 260 and this is conducted to bob 238, which in turn implies voltage to contact electrodes 236 effecting operation substantially similar to that of the transducers illustrated in FIGS. 1-16.

Figure 20:
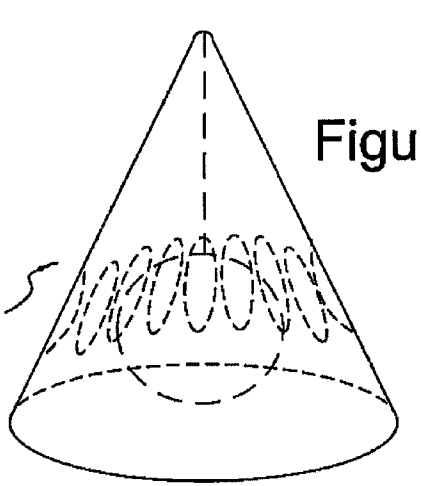
FIG. 20 illustrates an alternative embodiment of the present invention in a position tilted to the left.
Figure 18:
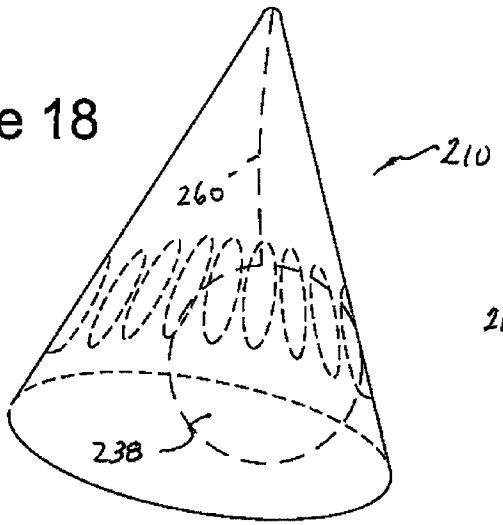
FIG. 18 illustrates an alternative embodiment of the present invention in a position tilted forwardly.
Figure 17:
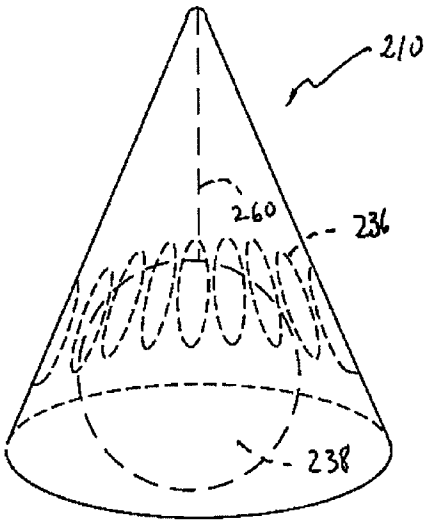
FIG. 17 illustrates an alternative embodiment of the present invention in the vertical position.
Figure 21:
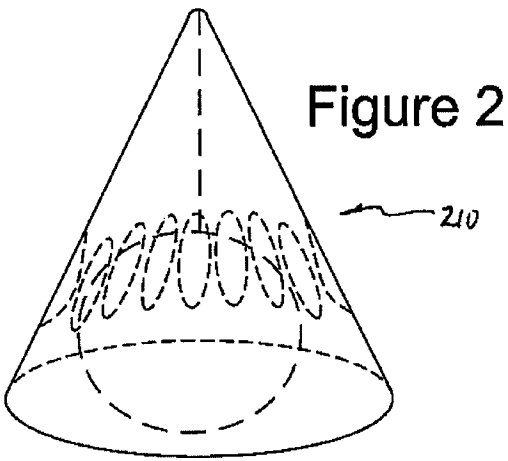
FIG. 21 illustrates an alternative embodiment of the present invention in a position tilted to the right.
Figure 19:
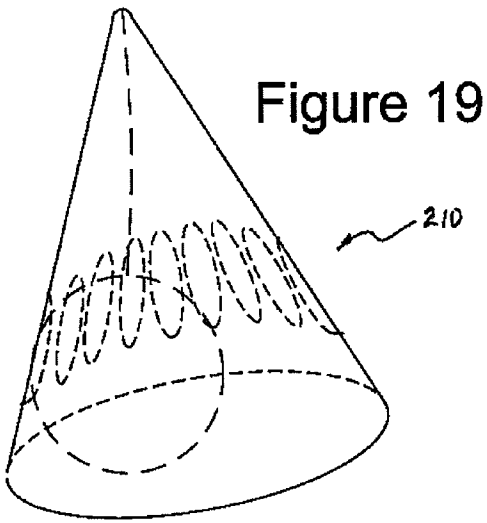
FIG. 19 illustrates an alternative embodiment of the present invention in a position tilted rearwardly.

FIG. 17 shows the transducer 210 in the upright or vertical position. FIG. 18 shows the transducer 210 on a flagpole tilted forwardly in position. FIG. 19 shows the transducer 210 on a flagpole tilted rearwardly. FIG. 20 shows the transducer 210 on a flagpole tilted to the right. FIG. 21 shows the transducer 210 on a flagpole tilted to the left.

While an illustrative embodiment of the invention has been described in this specification, and several alternatives thereto have also been described, modifications to the disclosed embodiments, and other embodiments will be apparent to those of ordinary skill in the art. For example, a malleable member or liquid conductor such as mercury or water may be substituted for the ball and socket arrangement of FIG. 16 a pendulum may be replaced by a quantity of conductive liquid with a wire (which takes the place of the conductive wire supporting the pendulum) or plurality of wires extending into it, for example at different points in the liquid. Likewise, the pendulum arrangement illustrated in FIGS. 17-21 may be achieved using a springy pendulum line 260. Such modifications are within the scope of the invention as limited and defined only by the appended claims.

What is claimed:

1. A device for maintaining a flagstaff at a desired position, the device comprising:

(a) a position transducer having a conical shaped body and a ball, the conical shaped body comprising a concave transducer cup having a floor and a sidewall, the ball disposed within and moveable about the cup, the ball making contact with a plurality of multi-contact sensors positioned around the conical shaped body including a floor contact sensor positioned on the floor of the cup and two or more sidewall contact sensors positioned at intervals along the sidewall, the contact of the ball and one or more of the contact sensors indicates a current position within one of a plurality of positions including a forward position, a rearward position, a center position, a right position, a left position and a position that is a combination thereof;

(b) a member supporting said position transducer on the flagstaff such that the position transducer indicates the current position of the flagstaff; and (c) a multi-mode alarm for indicating a deviation in the current position of the flagstaff from said desired position by producing a plurality of signals corresponding to the plurality of positions, the signals including a first signal that indicates the forward position, a second signal that indicates the rearward position, a third signal that indicates the center position, a fourth signal that indicates the right position, and a fifth signal that includes the left position.

2. A device as in claim 1, wherein the plurality of signals of the multi-mode alarm include an audio output differing in one of pitch, rate and type within the plurality of positions.

3. A device as in claim 2, wherein the audio output of said alarm indicates the current position of the flagstaff whereby a user may correct the position of the flagstaff in response thereto.

4. A device as in claim 1, wherein said conical shaped body is transparent thereby a position of the ball may be visually determined.

5. A device as in claim 1, wherein said member supporting said position transducer comprises a ball and socket attachment or a malleable member.

6. A device as in claim 5, wherein said member supporting said position transducer further comprises a slidable collar.

7. A device as in claim 1, wherein said member supporting said position transducer comprises a non-slidable collar.

8. A device as in claim 1 wherein said member supporting said position transducer comprises a collar and a ball and socket attachment.

9. A device as in claim 1 wherein the plurality of signals include audio output which varies in pitch and has bursts which vary in repetition rate to indicate the position within the plurality of positions of the flagstaff.

10. A device as in claim 1, wherein said ball is a conductive ball hanging on a pendulum arm.

11. A device as in claim 1, wherein said ball includes a quantity of a conductive liquid.

12. A device as in claim 2, wherein the center position is the desired position and the third signal is comprised of no audio output.

* * * * *